US009212337B2

(12) United States Patent
Lu

(10) Patent No.: US 9,212,337 B2
(45) Date of Patent: Dec. 15, 2015

(54) COLORED FLAME CANDLE AND MANUFACTURE THEREOF

(75) Inventor: Xin Lu, Jiande (CN)

(73) Assignee: JIANDE JIAXUAN ARTICLES CO., LTD., Jiande (CN)

( * ) Notice: Subject to any disclaimer, the term of this patent is extended or adjusted under 35 U.S.C. 154(b) by 1169 days.

(21) Appl. No.: 12/851,221

(22) Filed: Aug. 5, 2010

(65) Prior Publication Data

US 2011/0217663 A1 Sep. 8, 2011

(30) Foreign Application Priority Data

Mar. 8, 2010 (CN) ..... 2010 1 0128820

(51) Int. Cl.
*C11C 5/00* (2006.01)

(52) U.S. Cl.
CPC ..... *C11C 5/004* (2013.01); *C11C 5/006* (2013.01)

(58) Field of Classification Search
CPC ..... C11C 5/004; C11C 5/006
USPC ..... 44/275; 431/288
See application file for complete search history.

(56) References Cited

U.S. PATENT DOCUMENTS

| | | | | |
|---|---|---|---|---|
| 1,608,518 | A * | 11/1926 | Minrath | 431/126 |
| 2,184,666 | A * | 12/1939 | Fredericks | 431/126 |
| 3,582,251 | A * | 6/1971 | Concannon | 431/126 |
| 2004/0009444 | A1 * | 1/2004 | Lu | 431/126 |
| 2007/0056211 | A1 * | 3/2007 | Li et al. | 44/275 |
| 2010/0310999 | A1 * | 12/2010 | Qian | 431/288 |

FOREIGN PATENT DOCUMENTS

| | | | |
|---|---|---|---|
| CN | 1043340 | 6/1990 | C11C 5/00 |
| CN | 1073201 | 6/1993 | C11C 5/00 |
| CN | 02124149 | 7/2002 | C11C 5/00 |

* cited by examiner

*Primary Examiner* — Cephia D Toomer
(74) *Attorney, Agent, or Firm* — Ohlandt, Greeley, Ruggiero & Perle, L.L.P

(57) ABSTRACT

The present invention discloses a colored flame candle and manufacture thereof. The colored flame candle according to the present invention comprises a candle body and a candlewick, wherein the candle body comprises a primary combustion agent, an optional higher fatty acid amide and higher fatty acid triglyceride and an optional color-forming agent, and wherein the candlewick is pretreated with the color-forming agent so that it comprises the color-forming agent, the candlewick has a length exceeding that of the candle body wherein the exceeding portion is immersed with a melt candle body mixture so that it comprises the candle body mixture. The candlewick of the colored flame candle according to the present invention is easy to light, has a big flame after lighting, emits simultaneously with a colored flame upon lighting, is tight (non-blooming) and has a pleasing look, has a color consistent with that of the candle body, lights without dark smoke and does not go moldy in storage.

19 Claims, No Drawings

COLORED FLAME CANDLE AND MANUFACTURE THEREOF

FIELD OF THE INVENTION

The present invention relates to a novel colored flame candle and manufacture thereof. More particularly, the present invention relates to a colored flame candle with an improved overall performance, and manufacture thereof.

BACKGROUND OF THE INVENTION

Conventional colored flame candles are formed of a primary combustion agent, a color-forming agent and other adjuvants, and burn with a colored flame such as red, yellow, blue, green, violet, etc. With respect to formulations of colored flame candles and processes for manufacturing the same, there exist many patent publications. For example, Chinese Patent Application Publication No. CN1043340A discloses a colored flame candle and manufacture thereof, said colored flame candle comprising ethyl carbamate as the primary combustion agent, non-toxic organic or inorganic substances as the color-forming agent, which are soluble in ethyl carbamate, higher fatty alcohols as the strength improver, higher fatty acid amides as the lubricating and demoulding agent, higher fatty acids as the agent for improving combustion, cellulose derivatives as the film-forming agent and a resin solution or melt paraffin as the surface-protecting agent. Chinese Patent Application Publication No. CN 1073201A discloses a colored flame candle and manufacture thereof, said colored flame candle comprising organic polybasic acid esters as the primary combustion agent, higher fatty acids or higher fatty alcohols as the strength-improver, higher fatty acid amides as the demoulding agent, metal oxides as the candlewick improver, and metals or organic salts or complexes thereof as the color-forming agent. However, the colored flame candles disclosed in the prior art are fragile and less flexible and burn with instable flames.

In order to overcome the above disadvantages, the inventor of the present application developed a colored flame candle with improved candle body strength and good flame stability (see the Chinese Patent Application No. 02124149.X). In practice, the inventor found such colored flame candle has the following disadvantages: the candlewick is loose (blooming) and looks unpleasing, the color of the candlewick is inconsistent with that of the candle body, the candle is easy to go mouldy in storage and hard to light, has a small flame and cannot emit simultaneously with a colored flame upon lighting, and lights with dark smoke, etc. Thus, a novel colored flame candle that overcomes said disadvantages is desired.

SUMMARY OF THE INVENTION

The inventor of the present invention conducted extensive and deep study in the field of colored flame candles, aiming to develop a novel colored flame candle without the above disadvantages. As a result, the inventor of the present invention found that by pre-treating the candlewick with a color-forming agent so that the candlewick comprises the agent, making the length of the candlewick exceed the candle body in a certain proportion, and immersing the exceeding portion of the candlewick with a melt candle body mixture so that it comprises said candle body mixture, the candlewick of the colored flame candle would be easy to light, have a big flame after lighting, emit simultaneously with a colored flame upon lighting, be tight (non-blooming) and have a pleasing look, have a color consistent with that of the candle body, light without dark smoke and not go mouldy in storage. The present invention is completed based on the above findings.

An object of the present invention is to provide a novel colored flame candle, which overcomes the disadvantages associated with the prior candles, such as loose (blooming) and unpleasing looked candlewick, color inconsistency between the candlewick and the candle body, easiness to go mouldy in storage, hardness to light, a small flame after lighting, being unable to emit simultaneously with a colored flame upon lighting and dark smoke, so that the resultant product has a largely improved quality.

Another object of the present invention is to provide a process for manufacturing the above-mentioned novel colored flame candle.

Therefore, the present invention in its one aspect provides a colored flame candle, comprising a candle body and a candlewick, wherein the candle body comprises a primary combustion agent, an optional higher fatty acid amide and higher fatty acid triglyceride and an optional color-forming agent, wherein the candlewick is pretreated with the color-forming agent so that it comprises the color-forming agent, and has a length exceeding that of the candle body, wherein the exceeding portion is immersed with a melt candle body mixture so that it comprises the candle body mixture, and wherein the color-forming agent comprised in the candle body, if any, is the same as that used for pre-treating the candlewick.

The present invention in its second aspect provides a process for manufacturing a colored flame candle, comprising forming a uniform melt mixture of components for constituting the candle body, casting the resultant melt mixture into a mould containing a candlewick which comprises a color-forming agent by pretreatment therewith, with a length of the candlewick corresponding to the exceeding portion, cooling and then demoulding, and immersing the exceeding portion of the candlewick with a melt candle body mixture so that it comprises the candle body mixture, and cooling to obtain the final product; or comprising forming a uniform melt mixture of components for constituting the candle body, casting the resultant melt mixture into a mould containing a candlewick which comprises both a color-forming agent by pretreatment therewith and a melt candle body mixture by immersing therewith afterwards, with a length of the candlewick corresponding to the exceeding portion, cooling and then demoulding to obtain the final product;

or comprising forming a uniform melt mixture of components for constituting the candle body, casting the resultant melt mixture into a mould containing a candlewick which comprises a color-forming agent by pretreatment therewith, cooling and then demoulding to obtain the final product, wherein the mould has a pored portion at the end corresponding to the upper end of the candle, with the length of the pored portion corresponding to the exceeding portion of the candlewick and the diameter of the pored portion corresponding to that of the candlewick.

DETAILED DESCRIPTION OF THE INVENTION

The colored flame candle according to the present invention comprises a candle body and a candlewick, wherein said candle body comprises the following components, on the basis of the total weight of said candle body:

| | |
|---|---|
| primary combustion agent | 60-100% by weight |
| higher fatty acid amide | 0-15% by weight |
| higher fatty acid triglyceride | 0-15% by weight |
| color-forming agent | 0-10% by weight |

wherein the total content of components constituting said candle body is 100% by weight, and wherein the candlewick is pretreated with the color-forming agent so that it comprises the color-forming agent, the candlewick has a length exceeding that of the candle body wherein the exceeding portion is immersed with a melt candle body mixture so that it comprises the candle body mixture, and the color-forming agent comprised in the candle body, if any, is the same as that used for pre-treating the candlewick.

The primary combustion agent useful in the candle body of the colored flame candle according to the present invention can be selected from those conventionally employed in the art and examples thereof may include paraformaldehyde, ethyl hydroxyformate, paraffins, ceresin, ethyl carbamate(urethane), sorbic anhydride, organic polybasic acid esters, polyethylene glycols, hexamethylene-tetramine (urotropine), stearic acid, vinyl acetate-ethylene copolymer resins (EVA), etc., and mixtures thereof, preferably ethyl carbamate and organic polybasic acid esters such as di-$C_{1-5}$ alkyl oxalate, mono-$C_{1-5}$ alkyl succinate, tri-$C_{1-8}$ alkyl citrate, etc., and mixtures thereof, more preferably dimethyl oxalate, monomethyl succinate, trimethyl citrate, and most preferably trimethyl citrate. $C_{1-5}$ alkyl as mentioned above may be a branched or linear $C_{1-5}$ alkyl group, e.g. methyl, ethyl, n-propyl, isopropyl, n-butyl, isobutyl, sec-butyl, tert-butyl, n-amyl and sec-amyl. $C_{1-8}$ alkyl as mentioned above may be a branched or linear $C_{1-8}$ alkyl group, e.g. the examples mentioned for the $C_{1-5}$ alkyl, n-hexyl, sec-hexyl, n-heptyl, sec-heptyl, n-octyl, sec-octyl and 2-ethylhexyl.

In a colored flame candle according to the present invention, the amount of the primary combustion agent is 60 to 100% by weight, preferably 65 to 99% by weight, more preferably 75 to 98% by weight, based on the total weight of the candle body.

The higher fatty acid amide to be optionally used in the candle body of the colored flame candle according to the present invention can be selected from $C_{8-30}$ fatty acid amides, such as caprylamide, capramide, lauramide, tridecanamide, myristamide, palmitamide, stearamide, oleamide, etc., and mixtures thereof, preferably myristamide, stearamide or a mixture thereof.

In a colored flame candle according to the present invention, the amount of said higher fatty acid amide is 0 to 15% by weight, preferably 1 to 10% by weight, based on the total weight of the candle body.

The higher fatty acid triglyceride to be optionally used in the candle body of the colored flame candle according to the present invention may be selected from $C_{8-30}$ fatty acid triglycerides, such as glycerin tricaprylate, glycerin tricaprate, glycerin trilaurate, glycerin tri-tridecanoate, glycerin trimyristate, glycerin tripalmitate, glycerin tristearate (stearin), glycerin trioleate, etc., and mixtures thereof, preferably glycerin trilaurate, glycerin tripalmitate, stearin or a mixture thereof, most preferably stearin.

In a colored flame candle according to the present invention, the amount of said higher fatty acid triglyceride is used in an amount of 0 to 15% by weight, preferably 1 to 10% by weight, based on the total weight of the candle body.

In a colored flame candle according to the present invention, the color-forming agent comprised in the candle body, if any, is the same as that used for pre-treating the candlewick. The color-forming agent to be used for pre-treating the candlewick and if any, comprised in the candle body of the colored flame candle according to the present invention can be selected from those conventionally employed in the art, and examples thereof may be organic salts such as formates, acetates, propionates, citrates, stearates and etc., inorganic salts such as halides (for example, chlorides, bromides, etc.), oxycholorides, nitrates, sulfates and etc., and acids (such as boric acid), of lithium (Li), sodium (Na), potassium (K), boron (B), barium (Ba), calcium (Ca), cesium (Cs), aluminum (Al), copper (Cu), magnesium (Mg), strontium (Sr) or antimony (Sb), or complexes of the above-mentioned metals, or mixtures thereof, e.g. lithium propionate, sodium citrate, aluminum potassium sulfate, boric acid, potassium chloride, vanadium chloride, antimony oxycholoride, strontium nitrate, etc.

In a colored flame candle according to the present invention, the amount of said color-forming agent is 0 to 10% by weight, preferably 1 to 8% by weight, based on the total weight of the candle body.

The candle body of a colored flame candle according to the present invention may further comprise perfumes and/or pigments, which can be those conventionally employed in the art. Examples of perfumes may be santal oil, vanilla, clove oil, mango oil, lemon oil, etc. And the amount thereof can be that conventionally employed in the art, for example 0.001 to 0.1% by weight, preferably 0.005 to 0.05% by weight, based on the total weight of the candle body. Examples of pigments may be Oil Red, Oil Yellow, Oil Green, Oil Blue, etc. It is preferred that the pigments are chosen so that the color thereof is essentially consistent with that of the light emitted by the candlewick when the candle body is burnt. The amount of the pigments is that conventionally employed in the art, for example 0.001 to 0.1% by weight, preferably 0.005 to 0.05% by weight, based on the total weight of the candle body. Pigments may not be added, and a white candle body would burn with different colors of flame, depending on the color-forming agent in the candlewick. And candle bodies in different colors will burn with different colors of flame depending on the color-forming agent in the candlewick.

Furthermore, if desired, sucrose fatty acid esters, fatty acid mono-/di-glyceride and/or higher fatty alcohols can be used in the candle body of a colored flame candle according to the present invention. Suitable sucrose fatty acid esters include sucrose $C_{10-30}$ fatty acid esters, more preferably sucrose mono-$C_{10-30}$ fatty acid esters or sucrose poly-$C_{10-30}$ fatty acid esters, e.g. sucrose di-$C_{10-30}$ fatty acid esters, sucrose tri-$C_{10-30}$ fatty acid esters, etc. According to a particular embodiment of the present invention, sucrose fatty acid esters of the SE series supplied by Shanghai Longni Fine Chemicals Co., Ltd. are used, particularly preferred are SE11-SE15, and further preferred is SE11 (wherein the numerical value stands for the hydrophilic lipophilic balance value, i.e. HLB value). In a colored flame candle according to the present invention, the amount of sucrose fatty acid esters is preferably 1 to 3% by weight, based on the total weight of the candle body. Useful fatty acid mono-/di-glycerides include $C_{10-30}$ fatty acid mono-glyceride and $C_{10-30}$ fatty acid di-glyceride, preferably $C_{10-30}$ fatty acid mono-glyceride. According to a particular embodiment of the present invention, glyceryl monostearate is used. In a colored flame candle according to the present invention, the amount of fatty acid mono-/di-glyceride is 1 to 3% by weight, based on the total weight of the candle body. Useful higher fatty alcohols are $C_{10-30}$ fatty alcohols, preferably, $C_{12}$, $C_{16}$, $C_{18}$ fatty alcohols or mixtures thereof, preferably octadecanol. In a colored flame candle according to the present invention, the amount of higher fatty alcohols is 1 to 4.5% by weight, based on the total weight of the candle body.

Besides the above components, the candle body of the colored flame candle according to the present invention can also comprise oxidation accelerators conventionally employed in the art, such as vanadium pentoxide and/or chromium trioxide. The amount of oxidation accelerators is conventional in the art.

The candlewick of the colored flame candle according to the present invention can be selected from those conventionally employed in the art, such as cotton candlewick, e.g. pure absorbent cotton thread. The candlewick to be used in the colored flame candle according to the present invention may be subjected to a pretreatment with a color-forming agent according to a conventional manner in the art so that the candlewick comprises the color-forming agent. The pretreatment can be carried out by, for example, immersing, atomizing, spraying, etc. so that the candlewick comprises the color-forming agent. For example, the candlewick of the colored flame candle according to the present invention is pretreated by immersing, atomizing, spraying or the like with an aqueous solution of a color-forming agent and then drying, e.g. air-drying. The candlewick thus pretreated usually comprises 2 to 55% by weight of color-forming agent, based on the total weight of the candlewick that has been pretreated.

In addition, the candlewick pretreated with the color-forming agent can be further pretreated with other reagent (e.g. semicarbazide), and such pretreatment can be carried out in a conventional manner in the art, e.g. by immersing, atomizing, spraying, etc. As an alternative, the further pretreatment can be carried out prior to or concurrent with the pretreatment of the candlewick with the color-forming agent. In a particularly preferred embodiment, the candlewick of the colored flame candle according to the present invention, after the pretreatment with a color-forming agent, is pretreated by immersing with a 10 to 30 wt %, e.g. 20 wt % of an aqueous solution of semicarbazide for 1 to 30 minutes, e.g. 10 minutes and then air-drying, whereby the flame stability is substantially enhanced.

In order to improve the overall performance of the colored flame candle according to the present invention, the candlewick shall exceed the candle body in a certain proportion and the exceeding portion shall be immersed with a melt candle body material. For example, the length of the candlewick exceeding the candle body can be 80 to 200%, preferably 100 to 185%, more preferably 110 to 170%, and most preferably 130 to 160%, of the longest diameter of the cross section of the candle body.

The colored flame candle according to the present invention can be manufactured by a method essentially the same as one used in the prior art, e.g. forming a uniform melt mixture of components for constituting the candle body in the prescribed percentages (e.g. melting the components in the vessel by heating to 90 to 95° C.), casting the resultant melt mixture into a mould containing a candlewick which comprises a color-forming agent by pretreatment therewith, with a length of the candlewick corresponding to the exceeding portion, cooling and then demoulding, and immersing the left portion of the candlewick with a melt candle body mixture so that it comprises the candle body mixture, and cooling to obtain the final product. As an alternative, said method comprises forming a uniform melt mixture of components for constituting the candle body in the prescribed percentages (e.g. melting the components in the vessel by heating to 90 to 95° C.), casting the resultant melt mixture into a mould containing a candlewick which comprises a color-forming agent by pretreatment therewith and a melt candle body mixture by immersing therewith afterwards, with a length of the candlewick corresponding to the exceeding portion, cooling and then demoulding to obtain the final product. As another alternative, said method comprises forming a uniform melt mixture of components for constituting the candle body in the prescribed percentages (e.g. melting the components in the vessel by heating to 90 to 95° C.), casting the resultant melt mixture into a mould containing a candlewick which comprises a color-forming agent by pretreatment therewith, cooling and then demoulding to obtain the final product, wherein the mould has a pored portion at the end corresponding to the upper end of the candle, with the length of the pored portion corresponding to the exceeding portion of the candlewick and the diameter of the pored portion corresponding to that of the candlewick.

The cross section of the colored flame candle according to the present invention can be in any shape, such as circle, ellipse, rectangle, polygon, any irregular shape, etc., preferably cylinder.

Compared to colored flame candles in the prior art, the colored flame candle according to the present invention has a good overall performance and can be manufactured by a simple and low-cost process.

EXAMPLES

The present invention is further demonstrated by the following examples, which shall not be construed as limiting the scope of the present invention.

Unless otherwise indicated, the percentages described hereinbelow refer to weight percentages.

Example 1

The formulation for the candle body of a candle with a red flame is as follows:

| | |
|---|---|
| Trimethyl citrate | 96.98% |
| Stearamide | 1.5% |
| Stearin | 1.5% |
| Oil Red (Pigment) | 0.02% |

The above components are melt in a vessel heated at 90 to 95° C. to form a uniform melt mixture. A cotton candlewick is immersed with a 30% aqueous solution of lithium propionate and air dried to obtain a cotton candlewick comprising 19% by weight of lithium propionate. The cotton candlewick thus obtained is then placed into a mould, the length thereof exceeding the candle body of the colored flame candle to be prepared for 6 mm. The melt mixture is then cast into the mould containing said cotton candlewick, cooled and demoulded. The exceeding portion of the candlewick is immersed with said melt mixture of the candle body and cooled to obtain a finished colored flame candle, which is in the shape of a cylinder with a diameter of 4 mm.

Example 2

The formulation for the candle body of a candle with a red flame is as follows:

| | |
|---|---|
| Trimethyl citrate | 99.98% |
| Oil Red (Pigment) | 0.02% |

The colored flame candle is manufactured in a manner substantially same as Example 1, except that the candle body is formulated with the components as mentioned above in this Example.

Example 3

The formulation for the candle body of a candle with a yellow flame is as follows:

| | |
|---|---|
| Trimethyl citrate | 96.98% |
| Stearamide | 1.5% |
| Stearin | 1.5% |
| Oil Yellow (Pigment) | 0.02% |

The colored flame candle is manufactured in a manner substantially same as Example 1, except that the candle body is formulated with the components as mentioned above in this Example, and the cotton candlewick is pretreated in a manner as follows: a cotton candlewick is immersed with a 5% aqueous solution of sodium citrate and air dried to obtain a cotton candlewick comprising 2% by weight of sodium citrate.

Example 4

The formulation for the candle body of a candle with a blue flame is as follows:

| | |
|---|---|
| Trimethyl citrate | 96.98% |
| Stearamide | 1.5% |
| Stearin | 1.5% |
| Oil Blue (Pigment) | 0.02% |

The colored flame candle is manufactured in a manner essentially same as Example 1, except that the candle body is formulated with the components as mentioned above in this Example, and the cotton candlewick is pretreated in a manner as follows: a cotton candlewick is immersed with a 15% aqueous solution of aluminum potassium sulfate and air dried to obtain a cotton candlewick comprising 7% by weight of aluminum potassium sulfate.

Example 5

The formulation for the candle body of a candle with a green flame is as follows:

| | |
|---|---|
| Trimethyl citrate | 94.98% |
| Stearamide | 1.5% |
| Stearin | 1.5% |
| Boric acid | 2% |
| Oil Green (Pigment) | 0.02% |

The colored flame candle is manufactured in a manner essentially same as Example 1, except that the candle body is formulated with the components as mentioned above in this Example, and the cotton candlewick is pretreated in a manner as follows: a cotton candlewick is immersed with a 30% aqueous solution of boric acid and air dried to obtain a cotton candlewick comprising 21% by weight of boric acid.

Example 6

The formulation for the candle body of a candle with a violet flame is as follows:

| | |
|---|---|
| Trimethyl citrate | 94.98% |
| Stearamide | 1.5% |
| Stearin | 1.5% |
| Potassium chloride | 2% |
| Pigment Purple | 0.02% |

The colored flame candle is manufactured in a manner essentially same as Example 1, except that the candle body is formulated with the components as mentioned above in this Example, and the cotton candlewick is pretreated in a manner as follows: a cotton candlewick is immersed with a 6% aqueous solution of potassium chloride and air dried to obtain a cotton candlewick comprising 3% by weight of potassium chloride.

Example 7

The formulation for the candle body of a candle with a white flame is as follows:

| | |
|---|---|
| Trimethyl citrate | 96% |
| Stearamide | 1.5% |
| Stearin | 1.5% |
| Vanadium chloride | 1% |

The colored flame candle is manufactured in a manner essentially same as Example 1, except that the candle body is formulated with the components as mentioned above in this Example, and the cotton candlewick is pretreated in a manner as follows: a cotton candlewick is immersed with a 15% aqueous solution of vanadium chloride and air dried to obtain a cotton candlewick comprising 9% by weight of vanadium chloride.

Example 8

The formulation for the candle body of a candle with a magenta flame is as follows:

| | |
|---|---|
| Trimethyl citrate | 94.98% |
| Stearamide | 1.5% |
| Stearin | 1.5% |
| Strontium nitrate | 2% |
| Pigment Magenta | 0.02% |

The colored flame candle is manufactured in a manner essentially same as Example 1, except that the candle body is formulated with the components as mentioned above in this Example, and the cotton candlewick is pretreated in a manner as follows: a cotton candlewick is immersed with a 20% aqueous solution of strontium nitrate and air dried to obtain a cotton candlewick comprising 9% by weight of strontium nitrate.

Comparative Example 1

The formulation for the candle body of a candle with a red flame is as follows:

| | |
|---|---|
| Trimethyl citrate | 96.98% |
| Stearamide | 1.5% |
| Stearin | 1.5% |
| Oil Red (Pigment) | 0.02% |

The above components are melt in a vessel heated at 90 to 95° C. to form a uniform melt mixture, which is then cast into a mould containing a cotton candlewick which has comprised 19% by weight of lithium propionate by previously immersing with a 30% aqueous solution of lithium propionate and air drying, the cotton candlewick having a length exceeding the candle body of the colored flame candle to be prepared for 6 nm. The melt mixture is then cooled and demoulded to obtain a finished colored flame candle, which is in the shape of a cylinder with a diameter of 4 mm.

Burning Test

The colored flame candle obtained in Example 1 and that obtained in Comparative Example 1 are subjected to burning test and mildew test, obtaining the following results observed by naked eyes.

| Example | Candlewick | Color of candlewick | Flammability of candlewick | dark smoke | Mildew* | Whether emitting simultaneously with a colored flame upon lighting | Flame size** |
|---|---|---|---|---|---|---|---|
| Example 1 | Tight (non-blooming) | Consistent with the candle body | Flammable, directly lighted | light without dark smoke | Not found | Yes | Approx. 2.5 cm |
| Comp. Example 1 | Loose (blooming) | Inconsistent with the candle body | Not easy to be directly lighted, open firing is needed to melt the candle body, and the candlewick is not lighted until the wax fluid reaches the candlewick | light with dark smoke until the candle body is melt and reaches the candlewick | Mould spots are found in the candlewick | No | Approx. 1 cm |

*storage at room temperature for 68 hours

**measured by placing a dividing ruler beside the flame and observing with naked eyes

What is claimed is:

1. A colored flame candle, which comprises a candle body and a candlewick, wherein said candle body comprises the following components, on the basis of the total weight of said candle body:

| | |
|---|---|
| Primary combustion agent | 60-100% by weight |
| Higher fatty acid amide | 0-15% by weight |
| Higher fatty acid triglyceride | 0-15% by weight |
| Color-forming agent | 0-10% by weight |

wherein the total content of components constituting said candle body is 100% by to weight, and wherein the candlewick is pretreated with the color-forming agent so that it comprises the color-forming agent, the candlewick has a length exceeding that of the candle body wherein the exceeding portion is immersed with a melt candle body mixture so that it comprises the candle body mixture, and the color-forming agent comprised in the candle body, if any, is the same as that used for pretreating the candlewick, and wherein said candlewick, after the pretreatment with the color-forming agent, is further pretreated by immersing with a 10 to 30 wt % aqueous solution of semicarbazide for 1 to 30 minutes and then air-drying, and wherein said primary combustion agent is tri-$C_{1-8}$ alkyl citrate.

2. The colored flame candle as claimed in claim 1, wherein the amount of said primary combustion agent is 65 to 99% by weight, based on the total weight of the candle body.

3. The colored flame candle as claimed in claim 1, wherein said higher fatty acid amide is a $C_{8-30}$ fatty acid amide.

4. The colored flame candle as claimed in claim 1, wherein the amount of said higher fatty acid amide is 1 to 10% by weight, based on the total weight of the candle body.

5. The colored flame candle as claimed in claim 1, wherein said higher fatty acid triglyceride is a C.sub.8-30 fatty acid triglyceride.

6. The colored flame candle as claimed in claim 1, wherein the amount of said higher fatty acid triglyceride is 1 to 10% by weight, based on the total weight of the candle body.

7. The colored flame candle as claimed in claim 1, wherein said color-forming agent for pre-treating the candlewick, and that comprised in the candle body, if any, are selected from the group consisting of organic salts, inorganic salts or acids, of lithium (Li), sodium (Na), potassium (K), boron (B), barium (Ba), calcium (Ca), cesium (Cs), aluminum (Al), copper (Cu), magnesium (Mg), strontium (Sr) or antimony (Sb), complexes of the above-mentioned metals, and mixtures thereof.

8. The colored flame candle as claimed in claim 1, wherein the amount of the color-forming agent comprised in the candle body is 1 to 8% by weight, based on the total weight of the candle body.

9. The colored flame candle as claimed in claim 1, wherein said candle body further comprises perfume, pigments, sucrose fatty acid esters, fatty acid mono-/di-glyceride and/or higher fatty alcohols.

10. The colored flame candle as claimed in claim 1, wherein the portion of the candlewick exceeding the candle body has a length 80 to 200% of the longest diameter of the cross section of the candle body.

11. A process for manufacturing the colored flame candle as claimed in claim 1, comprising: 1) forming a uniform melt mixture of components for constituting the candle body, casting the resultant melt mixture into a mould containing a candlewick which comprises a color-forming agent by pretreatment therewith, with a length of the candlewick corresponding to the exceeding portion, cooling and then demoulding, and immersing the exceeding portion of the candlewick with the melt candle to body mixture so that it comprises the candle body mixture, and cooling to obtain the final product; or 2) forming a uniform melt mixture of components for constituting the candle body, casting the resultant melt mixture into a mould containing a candlewick which comprises a color-forming agent by pretreatment therewith and a melt candle body mixture by immersing therewith afterwards, with a length of the candlewick corresponding to the exceeding portion, cooling and then demoulding to obtain the final product; or 3) forming a uniform melt mixture of components for constituting the candle body, casting the resultant melt mixture into a mould containing a candlewick which comprises a color-forming agent by pretreatment therewith, cooling and then demoulding to obtain the final product, wherein said mould has a pored portion at the end corresponding to the upper end of said candle, with the length of said pored portion corresponding to the exceeding portion of said candlewick and the diameter of said pored portion corresponding to that of said candlewick.

12. The process as claimed in claim 11, wherein the length of the exceeding portion of the candlewick is 80 to 200% of the longest diameter of the cross section of the candle body.

13. The colored flame candle as claimed in claim 1, wherein said higher fatty acid amide is selected from the group consisting of caprylamide, capramide, lauramide, tridecanamide, myristamide, palmitamide, stearamide, oleamide, and mixtures thereof.

14. The colored flame candle as claimed in claim 1, wherein said higher fatty acid triglyceride is selected from the group consisting of glycerin tricaprylate, glycerin tricaprate, glycerin trilaurate, glycerin tri-tridecanoate, glycerin trimyristate, glycerin tripalmitate, glycerin tristearate (stearin), glycerin trioleate, and mixtures thereof.

15. The colored flame candle as claimed in claim 1, wherein the amount of said primary combustion agent is 75 to 98% by weight, based on the total weight of the candle body.

16. The colored flame candle as claimed in claim 1, wherein the portion of the candlewick exceeding the candle body has a length preferably 100 to 185% of the longest diameter of the cross section of the candle body.

17. The colored flame candle as claimed in claim 1, wherein the portion of the candlewick exceeding the candle body has a length 130 to 160% of the longest diameter of the cross section of the candle body.

18. The process as claimed in claim 11, wherein the length of the exceeding portion of the candlewick is 130 to 160% of the longest diameter of the cross section of the candle body.

19. The colored flame candle as claimed in claim 1, wherein said primary combustion agent is trimethyl citrate.

* * * * *